US010193266B1

(12) United States Patent
Lin

(10) Patent No.: US 10,193,266 B1
(45) Date of Patent: Jan. 29, 2019

(54) ELECTRICAL CONNECTOR DEVICE

(71) Applicant: Zon-Guang Lin, Taoyuan (TW)

(72) Inventor: Zon-Guang Lin, Taoyuan (TW)

( * ) Notice: Subject to any disclaimer, the term of this patent is extended or adjusted under 35 U.S.C. 154(b) by 0 days.

(21) Appl. No.: 15/841,287

(22) Filed: Dec. 13, 2017

(30) Foreign Application Priority Data

Sep. 15, 2017 (TW) ..... 106131654 A

(51) Int. Cl.
*H01R 13/502* (2006.01)
*H01R 13/6581* (2011.01)

(52) U.S. Cl.
CPC ..... *H01R 13/502* (2013.01); *H01R 13/6581* (2013.01)

(58) Field of Classification Search
CPC ..... H01R 13/502; H01R 13/6581
USPC ..... 439/607.58
See application file for complete search history.

(56) References Cited

U.S. PATENT DOCUMENTS 4,863,401 A * 9/1989 Talend ..... H01R 13/7197 439/607.43
5,888,100 A * 3/1999 Bofill ..... H01R 24/64 439/344
5,899,770 A * 5/1999 Ezawa ..... H01R 24/64 439/418
6,332,802 B2 * 12/2001 Hirokawa ..... H01R 13/514 439/418
7,147,505 B2 * 12/2006 Li ..... H01R 13/5804 439/455
8,038,461 B2 * 10/2011 Hsu ..... H01R 4/023 439/344

* cited by examiner

*Primary Examiner* — Tulsidas C Patel
*Assistant Examiner* — Travis Chambers
(74) *Attorney, Agent, or Firm* — Cheng-Ju Chiang

(57) ABSTRACT

An electrical connector device of the present invention is characterized that a shell is disposed at a second opening of a front end of a protective casing of the electrical connector device. The shell is hollow, and a third opening is disposed at a front end of the shell and is used to receive a rear end of a signal terminal housing of the electrical connector device. A second round hole corresponding to a first round hole of a rear end of the protective casing is disposed at a rear end of the shell. As a result, the shell is configured to reinforce strength of the protective casing. A life of use of the electrical connector device is prolonged since the protective casing and the signal terminal housing of the electrical connector device are difficult to be separated when the signal terminal housing is plugged or unplugged.

7 Claims, 5 Drawing Sheets

ELECTRICAL CONNECTOR DEVICE

BACKGROUND OF THE INVENTION

1. Field of the Invention

The present invention is related to an electrical connector device, and in particular to an electrical connector device of which a protective casing and a signal terminal housing are difficult to be separated when the signal terminal housing is plugged or unplugged. The electrical connector device in accordance with the present invention is applicable to an electrical connector, a signal terminal connector, or other similar apparatuses.

2. The Related Arts

A conventional electrical connector apparatus mainly includes a terminal body and a protective body. A rear end of the terminal body is sleeved in the protective body so as to protect a communication cable assembled with the terminal body from being directly dragged via the protective body when the electrical connector device is plugged or unplugged.

However, during a using process of the conventional electrical connector apparatus, the protective body is just configured to sleeve around the terminal body. The protective body may be prone to be separated from the terminal body when the electrical connector apparatus is plugged or unplugged. As a result the communication cable at a rear end of the terminal body is easily directly exposed outsides. Since most people are used to directly pull the communication cable at the rear end of the terminal body when they try to unplug the electrical connector apparatus. As a result, a bad electrical contact or disconnection between the communication cable and metal pieces disposed in the terminal body may be caused and failure of signal transmission further occurs.

SUMMARY OF THE INVENTION

A main object of the present invention is to provide an electrical connector device. The electrical connector device in accordance with the present invention is characterized that a shell is disposed at a second opening of a front end of a protective casing of the electrical connector device. The shell is hollow, and a third opening is disposed at a front end of the shell and is used to receive a rear end of a signal terminal housing of the electrical connector device. A second round hole corresponding to a first round hole of a rear end of the protective casing is disposed at a rear end of the shell. As a result, the shell is configured to reinforce strength of the protective casing. A life of use of the electrical connector device is prolonged and overall practicality of the electrical connector device is enhanced since the protective casing and the signal terminal housing of the electrical connector device are difficult to be separated when the signal terminal housing is plugged or unplugged.

Another object of the present invention is to provide an electrical connector device characterized that an open space is disposed at a front half section of a front face of the shell. A shield plate is disposed at a rear half section of the front face of the shell. A mouth is disposed at the shield plate. A sheet extends from an edge of the mouth, and is set to abut against and in a recess of an upper portion of the rear end of the signal terminal housing so as to assemble the shell and the signal terminal housing together. As a result, the signal terminal housing is configured to be well protected, and becomes less prone to be broken or damaged. Overall practicality of the electrical connector device is therefore enhanced.

In order to achieve the above mentioned object(s), the electrical connector device in accordance with the present invention comprises the signal terminal housing and the protective casing. A first opening is disposed at the rear end of the signal terminal housing, and a plurality of slots are disposed at an upper portion of a front end of the signal terminal housing. A second opening is disposed at a front end of the protective casing, and a first round hole disposed at the rear end of the protective casing. The electrical connector device in accordance with the present invention is characterized that the shell is disposed at the second opening of the front end of the protective casing, the shell is hollow, and the third opening is disposed at the front end of the shell and is used to receive the rear end of the signal terminal housing having the first opening, a second round hole corresponding to the first round hole of the rear end of the protective casing is disposed at a rear end of the shell.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENT

Referring to FIGS. 1 to 5, schematic views of an electrical connector device in accordance with an embodiment of the present invention are shown. An electrical connector device in accordance with the present invention is preferably applied to an electrical connector, a signal terminal connector or other similar apparatus. The electrical connector device of the present invention enables them to become less prone to be broken or damaged.

Figure 1:
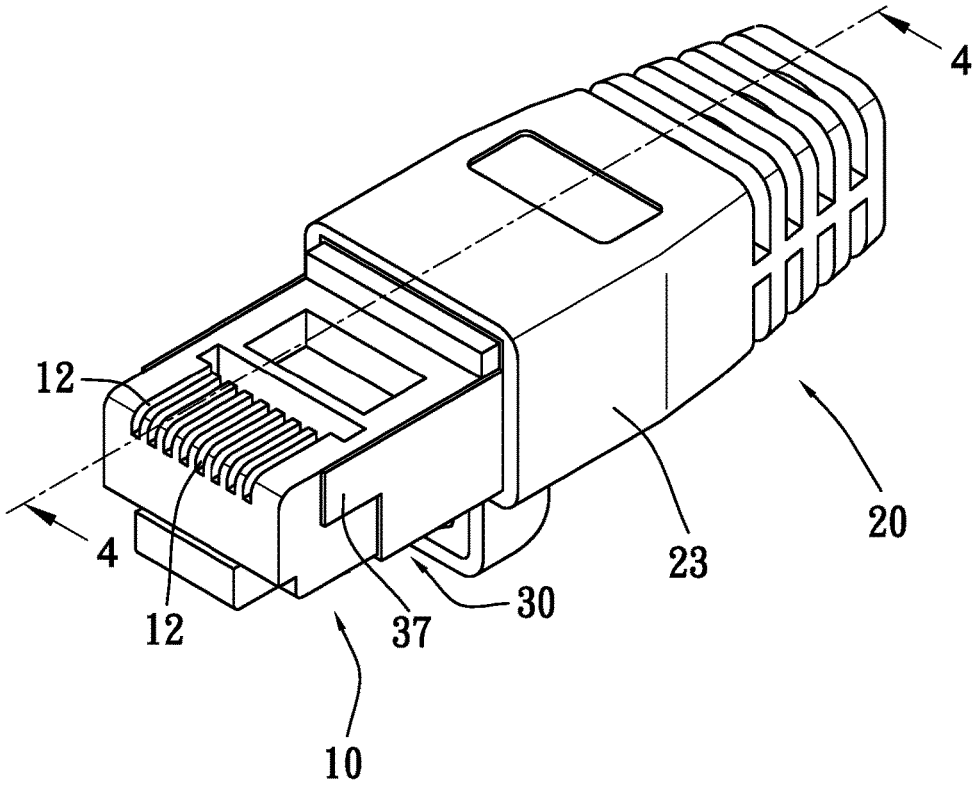
FIG. 1 is a schematic perspective view of an electrical connector device in accordance with the present invention.
Figure 3:
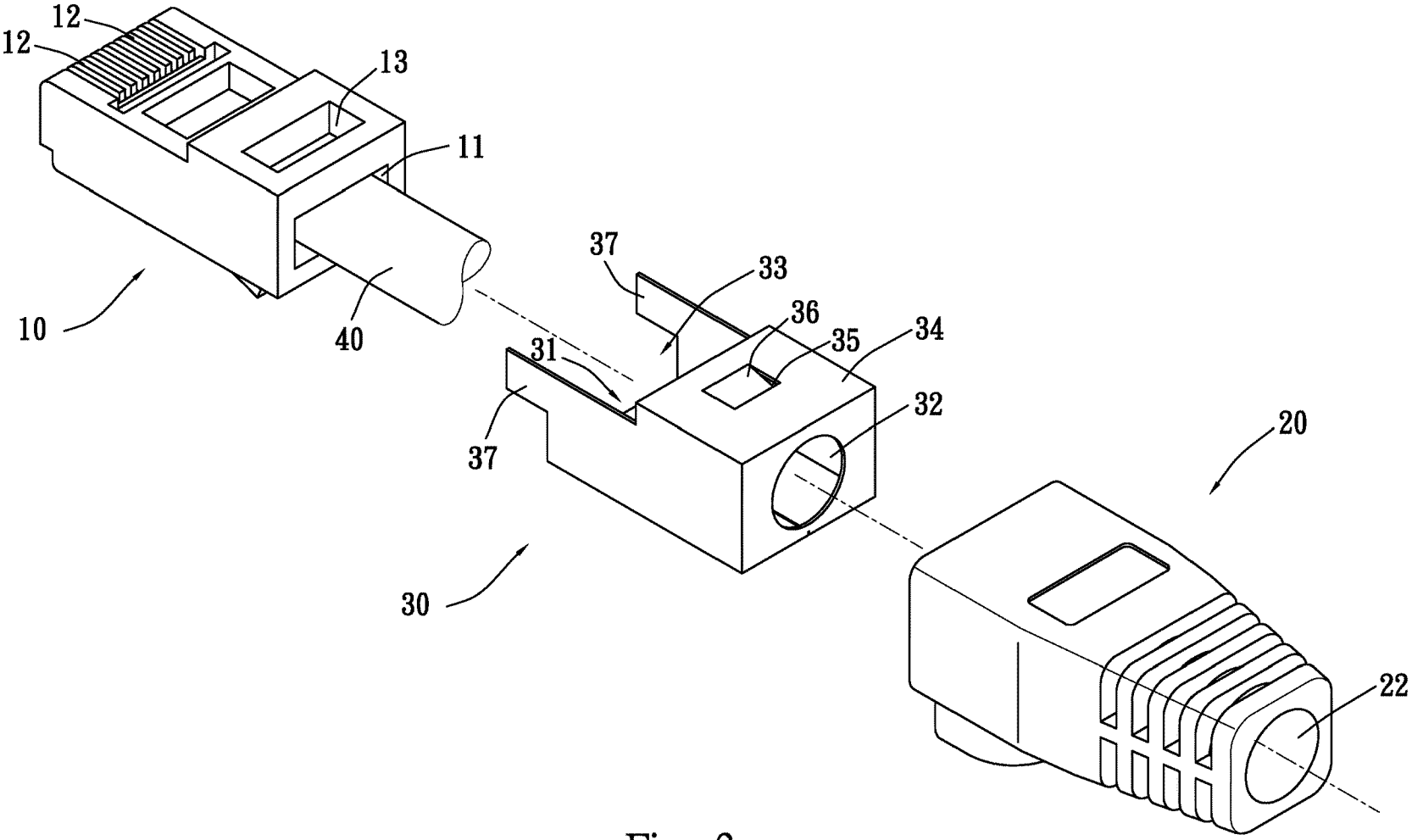
FIG. 3 is a schematic exploded perspective view of the electrical connector device of FIG. 1 viewed from another viewing angle in accordance with the present invention.
Figure 4:
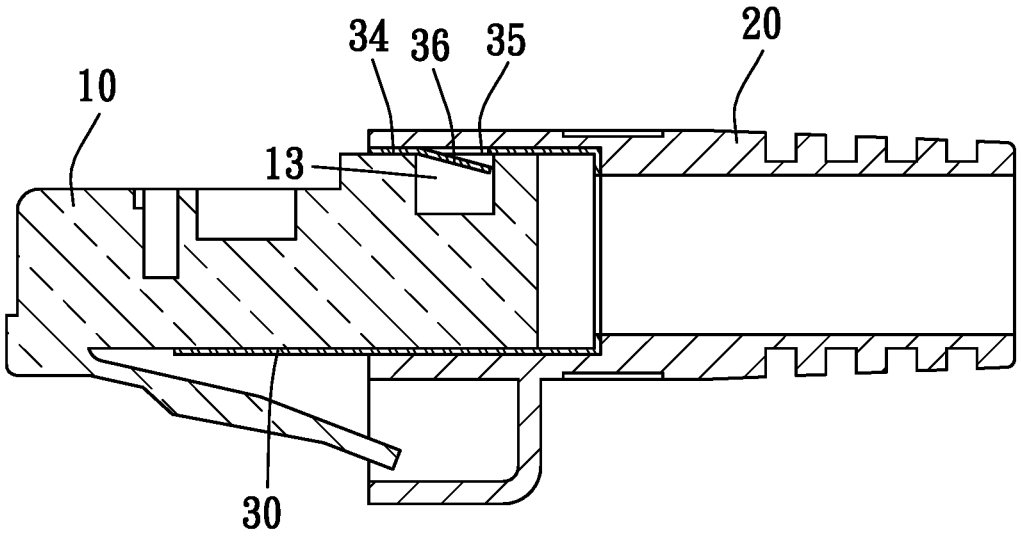
FIG. 4 is a schematic cross-sectional view of the electrical connector device of FIG. 1 taken along line 4-4 in FIG. 1 in accordance with the present invention.

The electrical connector device of the present invention comprises a signal terminal housing 10 and a protective casing 20 (as shown in FIG. 1). The signal terminal housing 10 is made of plastic, acrylic or other materials. A first opening 11 is disposed at a rear end of the signal terminal housing 10, and a plurality of slots 12 are disposed at an upper portion of a front end of the signal terminal housing 10. A recess 13 is disposed at an upper portion of the rear end of the signal terminal housing 10 (as shown in FIG. 3). A plurality of metal contact pieces (not shown) are respectively correspondingly disposed inside the plurality of slots 12 of the signal terminal housing 10, and are electrically contacted and connected with a communication cable 40.

The communication cable 40 comprises a plurality of signal wires having different functions from one another. Each of the plurality of signal wires is electrically connected and communicated with a corresponding one of the plurality of metal contact pieces. The communication cable 40 extends and passes through the first opening 11 at the rear end of the signal terminal housing 10 (as shown in FIGS. 2 and 3).

Figure 2:
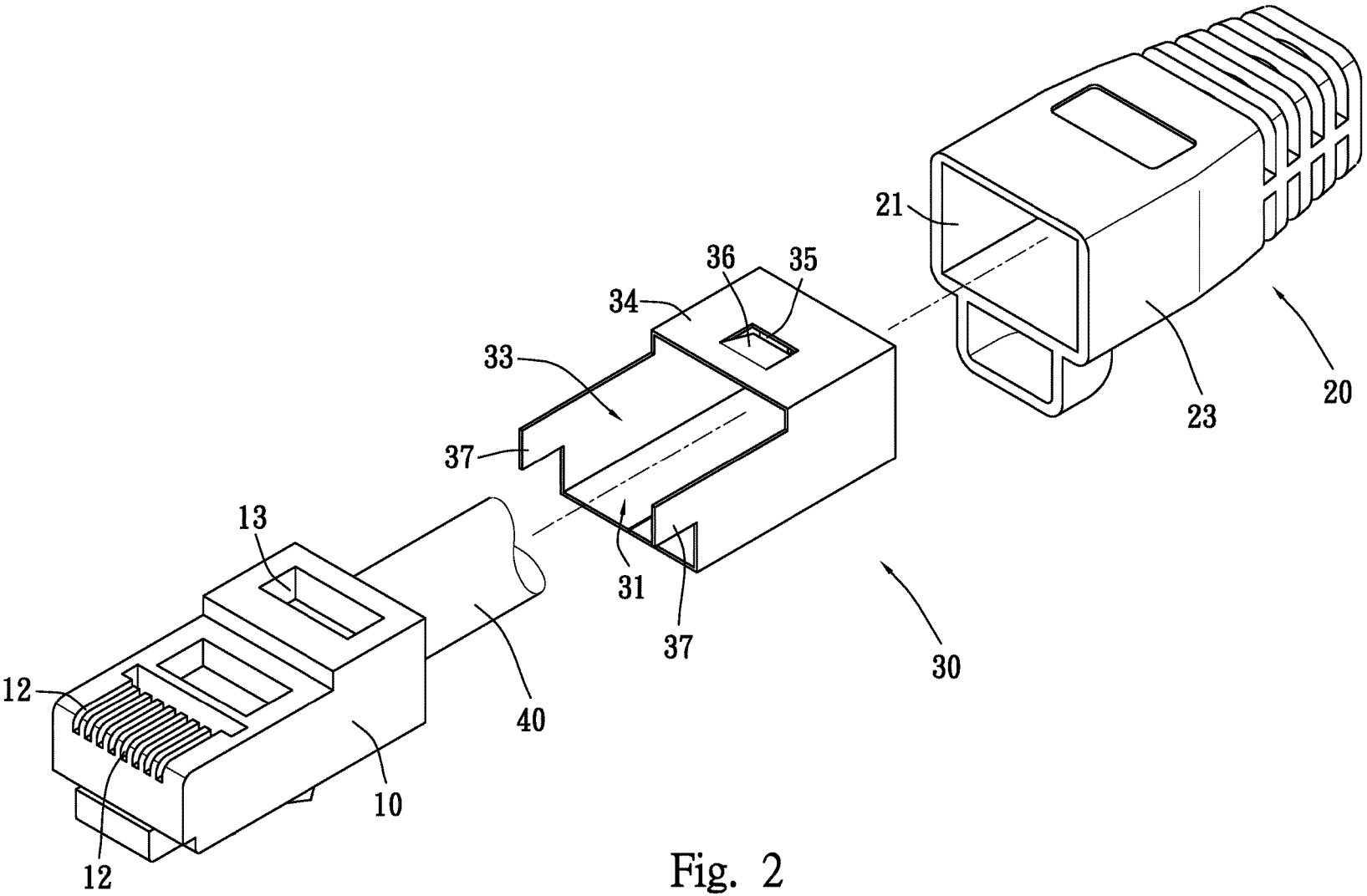
FIG. 2 is a schematic exploded perspective view of the electrical connector device of FIG. 1 in accordance with the present invention.

A second opening 21 is disposed at a front end of the protective casing 20, and a first round hole 22 is disposed at a rear end of the protective casing 20 (as shown in FIGS. 2 and 3). The protective casing 20 is made of plastic material. The front end of the protective casing 20 is substantially a hollow rectangular block 23, and the rear end of the protective casing 20 is substantially a hollow cylinder which is formed by the protective casing 20 being gradually shrunk in size from the front end thereof to the rear end thereof. The front end of the protective casing 20 is therefore able to receive the rear end of the signal terminal housing 10. Besides, a dimension of the second opening 21 of the front end of the protective casing 20 is larger than a dimension of the first opening 11 of the rear end of the signal terminal housing 10.

The present invention is mainly characterized that a shell 30 is disposed at the second opening 21 of the front end of the protective casing 20 (Referring to FIGS. 2 and 3). The shell 30 is made of metal material, and can be formed by bending a sheet piece of iron material. The shell 30 can alternatively be made of other material (such as plastic material) and is therefore shaped by injection molding. Material of the shell 30 is not limited by the related descriptions for the present invention. The shell 30 is hollow, and a third opening 31 is disposed at a front end of the shell 30. The third opening 31 of the shell 30 is used to receive the rear end of the signal terminal housing 10 having the first opening 11. A second round hole 32 corresponding to the first round hole 22 of the rear end of the protective casing 20 is disposed at a rear end of the shell 30.

Furthermore, an open space 33 is disposed at a front half section of a front face of the shell 30, i.e., no shielding is formed above the open space 33, and a shield plate 34 is disposed at a rear half section of the front face of the shell 30. A height of the rear half section of the front face of the shell 30 is larger than a height of the front half section of the front face of the shell 30. A length of the shield plate 34 is equal to a length of the hollow rectangular block 23 of the front end of the protective casing 20. In addition, a mouth 35 is disposed at the shield plate 34. A sheet 36 is disposed at an edge of the mouth 35, and extends to bend inwards. The sheet 36 is set to abut against and in the recess 13 of the upper portion of the rear end of the signal terminal housing 10 (Referring to FIG. 4) so as to assemble the shell 30 and the signal terminal housing 10 together.

Additionally, a lateral plate 37 is formed by extending forwards from each of two sidewalls of the shell 30. A step shape is formed by the lateral plate 37 and a corresponding sidewall of the shell 30 where the lateral plate 37 extends from. An extending distance of the lateral plate 37 forwardly extending away from a rear side of the shell 30 is larger than an extending distance of the corresponding sidewall of the shell 30 away from the rear side of the shell 30. Hence, the lateral plates 37 extending forwards respectively from the two sidewalls of the shell 30 are respectively attached to two sidewalls of the signal terminal housing 10 (Referring to FIGS. 1 and 5) in order to enhance protection on the two sidewalls of the signal terminal housing 10.

Figure 5:
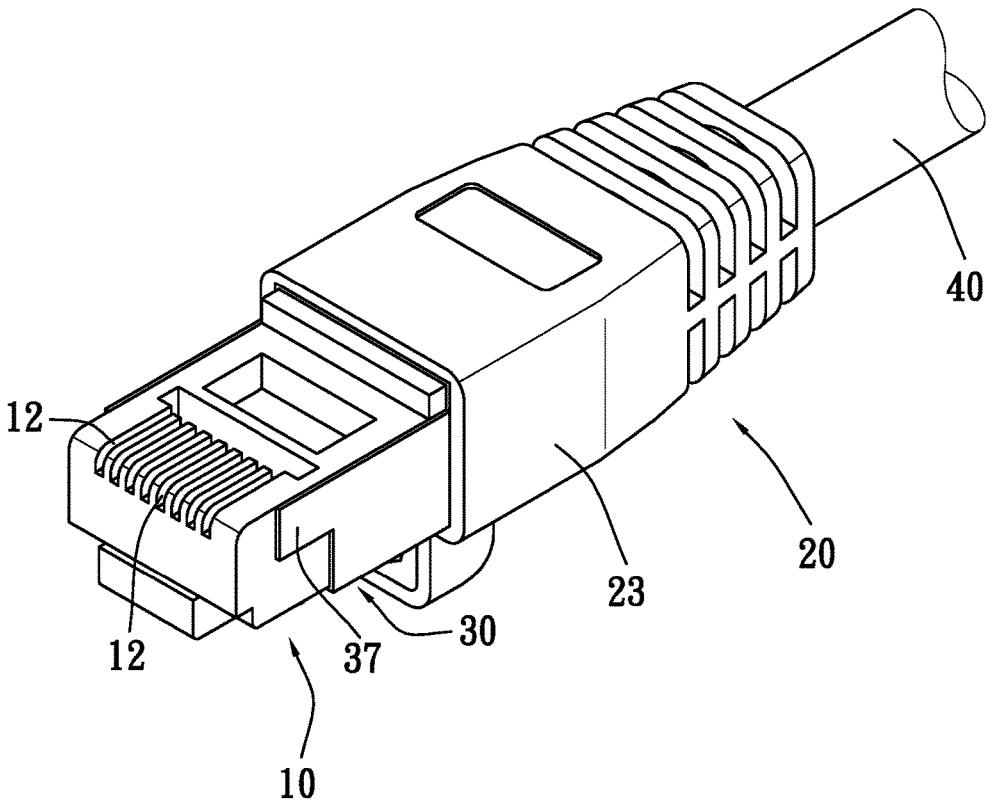
FIG. 5 is a schematic perspective view of the electrical connector device of FIG. 1 equipped with a communication cable in accordance with the present invention.

The communication cable 40 electrically contacted and connected with the plurality of metal contact pieces disposed inside the signal terminal housing 10 is set to firstly penetrate through the first opening 11 of the rear end of the signal terminal housing 10 (Referring to FIGS. 2 and 3), then to penetrate sequentially through the third opening 31 of the front end of the shell 30 and the second round hole 32 of the rear end of the shell 30, and finally to pass through the first round hole 22 of the rear end of the protective casing 20 for being exposed therefrom (Referring to FIG. 5). The communication cable 40 further extends to another end of the electrical connector device (not shown) of the present invention for configuration of the electrical connector device. Therefore, the shell 30 is configured to reinforce strength of the protective casing 20. As a result, a life of use of the electrical connector device is prolonged and overall practicality of the electrical connector device is enhanced since the protective casing 20 and the signal terminal housing 10 of the electrical connector device of the present invention are difficult to be separated when the signal terminal housing 10 is plugged or unplugged.

Although only the preferred embodiments of the present invention are described as above, the claim scope of the present invention is not limited to the disclosed embodiments. It is understood that any simple equivalent changes, adjustments or modifications to the present invention can be made by ordinary skilled in the art without separating from the inventive spirit and the claimed scope of the present invention. Hence, the protective scope of the present invention should be defined by the claimed scope of the following claims of the present invention.

What is claimed is:

1. An electrical connector device comprising a signal terminal housing and a protective casing, a first opening disposed at a rear end of the signal terminal housing, and a plurality of slots disposed at an upper portion of a front end of the signal terminal housing, a second opening disposed at a front end of the protective casing, and a first round hole disposed at a rear end of the protective casing, wherein a shell is disposed at the second opening of the front end of the protective casing, the shell is hollow, and a third opening is disposed at a front end of the shell and is used to receive the rear end of the signal terminal housing having the first opening, a second round hole corresponding to the first round hole of the rear end of the protective casing is disposed at a rear end of the shell;

wherein an open space is disposed at a front half section of a front face of the shell, and a shield plate is disposed at a rear half section of the front face of the shell, a mouth is disposed at the shield plate, a sheet extends from an edge of the mouth;

wherein the sheet extending from the edge of the mouth of the shield plate is set to abut against the signal terminal housing, a recess is disposed at an upper portion of the rear end of the signal terminal housing, the sheet extending from the edge of the mouth of the shield plate is set to abut against and in the recess of the upper portion of the rear end of the signal terminal housing.

2. The electrical connector device as claimed in claim 1, wherein a height of the rear half section of the front face of the shell is larger than a height of the front half section of the front face of the shell.

3. The electrical connector device as claimed in claim 1, wherein the shell is formed by bending a sheet piece.

4. The electrical connector device as claimed in claim 1, wherein the shell is made of metal material.

5. The electrical connector device as claimed in claim 1, wherein a plurality of metal contact pieces are respectively correspondingly disposed inside the plurality of slots, and are electrically contacted and connected with a communication cable, the other end of the communication cable firstly penetrates through the first opening of the rear end of the signal terminal housing, then penetrates sequentially through the third opening of the front end of the shell and the second round hole of the rear end of the shell, and finally passes through the first round hole of the rear end of the protective casing for being exposed therefrom.

6. The electrical connector device as claimed in claim 1, wherein a lateral plate extends forwards from each of two sidewalls of the shell, a step shape is formed by the lateral plate and a corresponding sidewall of the shell where the lateral plate extends from.

7. The electrical connector device as claimed in claim 6, wherein an extending distance of the lateral plate forwardly extending away from a rear side of the shell is larger than an extending distance of the corresponding sidewall of the shell away from the rear side of the shell.

* * * * *